US011199337B2

(12) United States Patent
Kawashima et al.

(10) Patent No.: US 11,199,337 B2
(45) Date of Patent: Dec. 14, 2021

(54) AIR CONDITIONER

(71) Applicant: Mitsubishi Electric Corporation, Tokyo (JP)

(72) Inventors: Mitsuru Kawashima, Tokyo (JP); Katsuhiro Ishimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 6 days.

(21) Appl. No.: 16/955,332

(22) PCT Filed: Apr. 9, 2018

(86) PCT No.: PCT/JP2018/014961
§ 371 (c)(1),
(2) Date: Jun. 18, 2020

(87) PCT Pub. No.: WO2019/198134
PCT Pub. Date: Oct. 17, 2019

(65) Prior Publication Data

US 2021/0010704 A1 Jan. 14, 2021

(51) Int. Cl.
*F24F 11/36* (2018.01)
*F24F 1/26* (2011.01)
(Continued)

(52) U.S. Cl.
CPC ..... *F24F 11/36* (2018.01); *F24F 1/26* (2013.01); *F25B 45/00* (2013.01); *F25B 49/02* (2013.01)

(58) Field of Classification Search
CPC ... F24F 11/36; F24F 1/26; F25B 45/00; F25B 49/02
See application file for complete search history.

(56) References Cited

U.S. PATENT DOCUMENTS 6,085,531 A * 7/2000 Numoto ..... F25B 49/005 62/149
2003/0213254 A1* 11/2003 Koo ..... F25B 13/00 62/174
(Continued)

FOREIGN PATENT DOCUMENTS

GB 2564995 A 1/2019
JP 2000-097527 A 4/2000
(Continued)

OTHER PUBLICATIONS

International Search Report of the International Searching Authority dated Jun. 12, 2018 for the corresponding international application No. PCT/JP2018/014961 (and English translation).
(Continued)

*Primary Examiner* — Henry T Crenshaw
(74) *Attorney, Agent, or Firm* — Posz Law Group, PLC

(57) ABSTRACT

An air conditioner that includes a refrigerant circuit connecting a plurality of indoor heat exchangers in parallel and is able to complete collection of refrigerant to the side of an outdoor heat exchanger in a shorter time when the refrigerant has leaked at any indoor heat exchanger is provided. Thus, in the air conditioner according to the present invention, when refrigerant leak is detected by a refrigerant leak sensor provided in an indoor unit and refrigerant leak is not detected by a refrigerant leak sensor provided in an indoor unit, an indoor LEV and a cutoff valve are closed to isolate an indoor heat exchanger of the indoor unit from the refrigerant circuit in a refrigerant pump-down operation. When refrigerant leak is detected by the refrigerant leak sensor and refrigerant leak is not detected by the refrigerant leak sensor, an indoor LEV and a cutoff valve are closed.

2 Claims, 8 Drawing Sheets

(51) Int. Cl.
*F25B 45/00* (2006.01)
*F25B 49/02* (2006.01)

(56) References Cited

U.S. PATENT DOCUMENTS

2004/0216480 A1* 11/2004 Jang ..... F25B 13/00
62/324.5
2011/0067421 A1* 3/2011 Shiraishi ..... B60H 1/00978
62/149
2013/0014525 A1* 1/2013 Koge ..... F24F 1/32
62/126
2016/0356534 A1* 12/2016 Hatada ..... F25B 49/02

FOREIGN PATENT DOCUMENTS

JP 2007-178026 A 7/2007
JP 2007-178026 * 12/2007
JP 2015-094573 A 5/2015
JP 2016-011781 A 1/2016
JP 2016-011782 A 1/2016
WO 2018/003096 A1 1/2018

OTHER PUBLICATIONS

European Office Action dated Mar. 23, 2021, issued in corresponding European Patent Application No. 18914043.7.
Chinese Office Action dated Jul. 22, 2021, issued in corresponding CN Patent Application No. 201880089107.4 ( and English translation).

* cited by examiner

FIG. 7

| | CUTOFF VALVE 45a | CUTOFF VALVE 45b | CUTOFF VALVE 46a | CUTOFF VALVE 46b |
|---|---|---|---|---|
| FULL COOLING OPERATION | × | × | ○ | ○ |
| FULL HEATING OPERATION | ○ | ○ | × | × |
| INDOOR UNIT 1:HEAT INDOOR UNIT 2:COOL | ○ | × | × | ○ |
| INDOOR UNIT 1:COOL INDOOR UNIT 2:HEAT | × | ○ | ○ | × |
| REFRIGERANT LEAK DETECTED AT INDOOR UNIT 1 | × | × | ○ | × |
| REFRIGERANT LEAK DETECTED AT INDOOR UNIT 2 | × | × | × | ○ |

AIR CONDITIONER

CROSS REFERENCE TO RELATED APPLICATION

This application is a U.S. national stage application of PCT/JP2018/014961 filed on Apr. 9, 2018, the contents of which are incorporated herein by reference.

FIELD

The present invention relates to an air conditioner.

BACKGROUND

It has been known that, in an air conditioner in which combustible refrigerant is introduced into a refrigerant circuit connecting a compressor, an indoor heat exchanger, and an outdoor heat exchanger, an electromagnetic expansion valve is provided in a refrigerant circuit not including the compressor between the outdoor heat exchanger and the indoor heat exchanger, and a cutoff valve is provided in a refrigerant circuit including the compressor between the indoor heat exchanger and the outdoor heat exchanger. When leak of the combustible refrigerant from the refrigerant circuit is detected, a pump-down operation is performed in which the electromagnetic expansion valve is closed while operation of the compressor is continued, and the operation of the compressor is stopped and the cutoff valve is closed after a predetermined time has elapsed, thereby collecting the refrigerant in the refrigerant circuit to the side of the outdoor heat exchanger (refer to PTL 1, for example).

CITATION LIST

Patent Literature

[PTL 1] JP 2000-097527 A

SUMMARY

Technical Problem

However, when such a technology disclosed in PTL 1 is applied to an air conditioner including a refrigerant circuit connecting a plurality of indoor heat exchangers and an outdoor heat exchanger, the plurality of indoor heat exchangers connected in parallel, the outdoor heat exchanger connected in series to the plurality of indoor heat exchangers, refrigerant is collected to the side of the outdoor heat exchanger for all of the plurality of indoor heat exchangers in the pump-down operation, and thus it takes time until the pump-down operation is completed.

The present invention is intended to solve such a problem. It is an objective of the present invention to obtain an air conditioner that includes a refrigerant circuit connecting a plurality of indoor heat exchangers and an outdoor heat exchanger and is able to complete refrigerant collection to the side of the outdoor heat exchanger in a shorter time when refrigerant leak has been detected on the side of any indoor heat exchanger, the plurality of indoor heat exchangers connected in parallel, the outdoor heat exchanger connected in series to the plurality of indoor heat exchangers.

Solution to Problem

An air conditioner according to the present invention includes: a refrigerant circuit connecting a first indoor heat exchanger, a second indoor heat exchanger and an outdoor heat exchanger by a refrigerant pipe in which refrigerant is enclosed, the first indoor heat exchanger and the second indoor heat exchanger connected in parallel, the outdoor heat exchanger connected in series to the first indoor heat exchanger and the second indoor heat exchanger; a first indoor unit casing housing the first indoor heat exchanger; a second indoor unit casing housing the second indoor heat exchanger; a first leak detector configured to detect a leak of the refrigerant inside the first indoor unit; a second leak detector configured to detect a leak of the refrigerant inside the second indoor unit; a first isolator configured to isolate the first indoor heat exchanger from the refrigerant circuit; a second isolator configured to isolate the second indoor heat exchanger from the refrigerant circuit; a controller configured to, when at least one of the first leak detector and the second leak detector detects the leak of the refrigerant, perform a pump-down operation in which the refrigerant is collected to a side of the outdoor heat exchanger, the controller configured to isolate the second indoor heat exchanger from the refrigerant circuit by the second isolator in the pump-down operation when the first leak detector detects the leak of the refrigerant and the second leak detector does not detect the leak of the refrigerant, and to isolate the first indoor heat exchanger from the refrigerant circuit by the first isolator in the pump-down operation when the second leak detector detects the leak of the refrigerant and the first leak detector does not detect the leak of the refrigerant.

Advantageous Effects of Invention

An air conditioner according to the present invention includes a refrigerant circuit connecting a plurality of indoor heat exchangers and an outdoor heat exchanger and is able to complete refrigerant collection to the side of the outdoor heat exchanger in a shorter time when refrigerant leak has been detected on the side of any indoor heat exchanger, the plurality of indoor heat exchangers connected in parallel, the outdoor heat exchanger connected in series to the plurality of indoor heat exchangers.

BRIEF DESCRIPTION OF THE DRAWINGS

FIG. 7 is a diagram illustrating the opened or closed state of each valve of a relay unit included in the air conditioner according to Embodiment 2 of the present invention.

DESCRIPTION OF EMBODIMENTS

Figure 1:
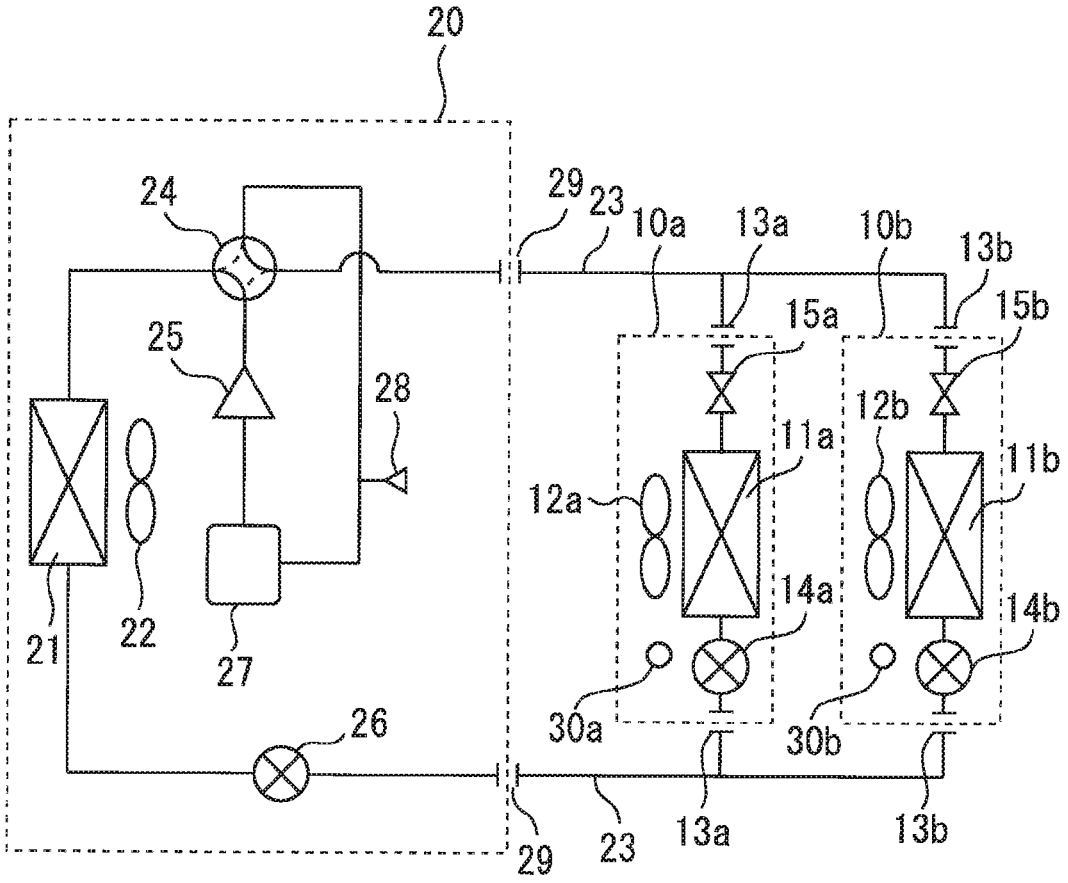
FIG. 1 is a diagram illustrating the entire configuration of a refrigerant circuit included in an air conditioner according to Embodiment 1 of the present invention.

Embodiments of the present invention will be described below with reference to the accompanying drawings. In the drawings, identical or equivalent components are denoted by an identical reference sign, and duplicate description thereof is simplified or omitted as appropriate. The present invention is not limited to the embodiments described below but may be modified in various manners without departing from the scope of the present invention.

Embodiment 1

Figure 2:
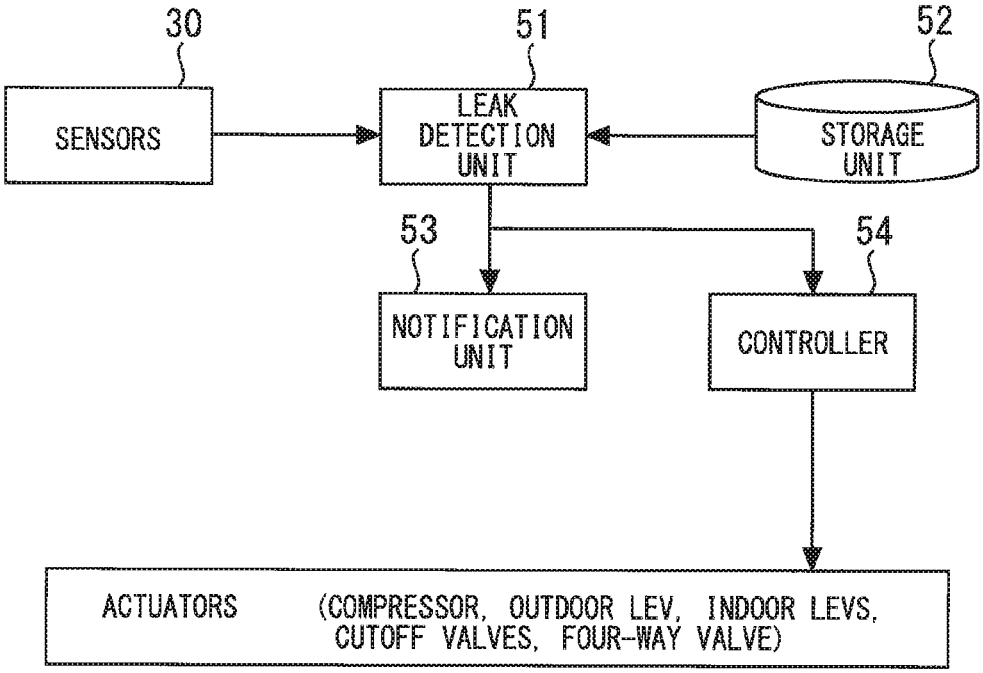
FIG. 2 is a block diagram illustrating the configuration of a control system of the air conditioner according to Embodiment 1 of the present invention.
Figure 3:
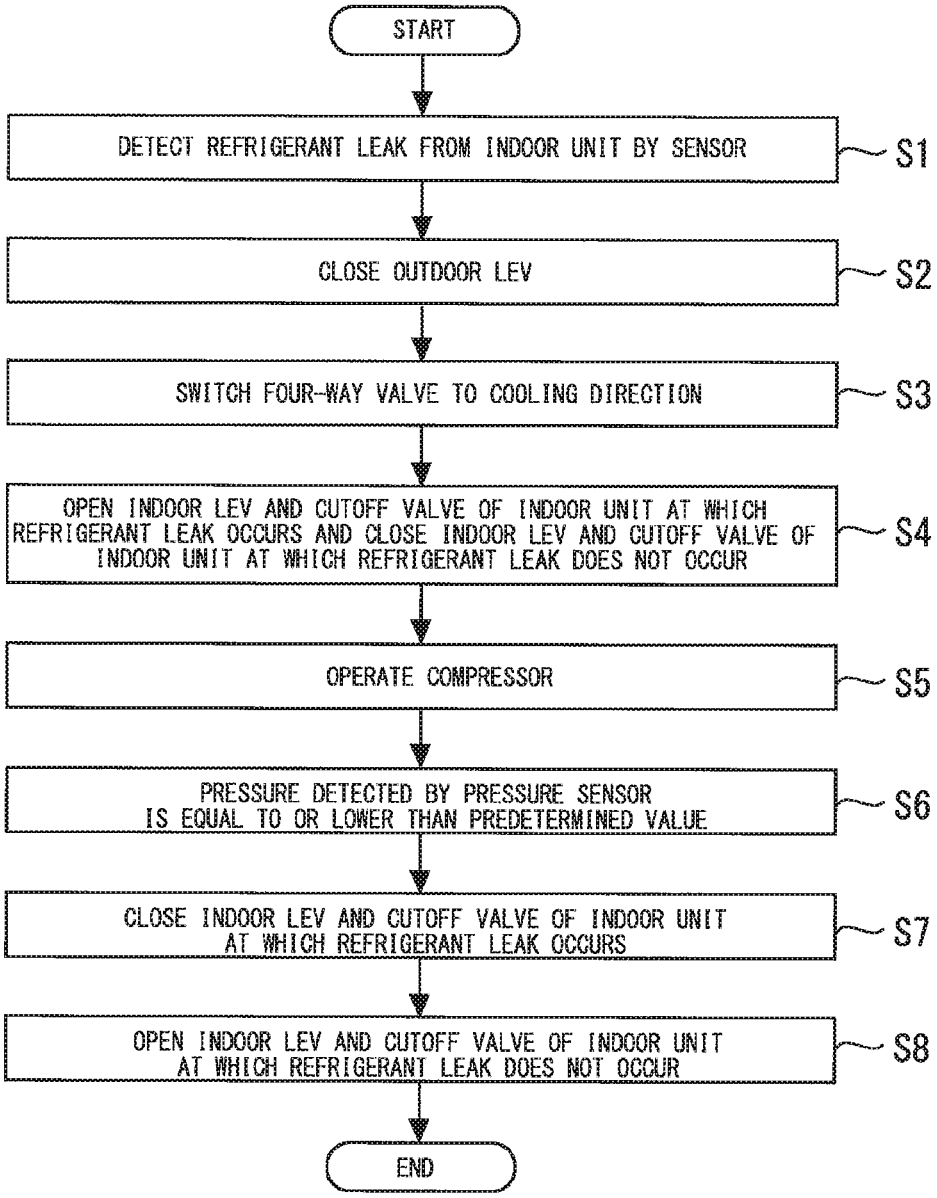
FIG. 3 is a flowchart illustrating exemplary operation of the air conditioner according to Embodiment 1 of the present invention.
Figure 4:
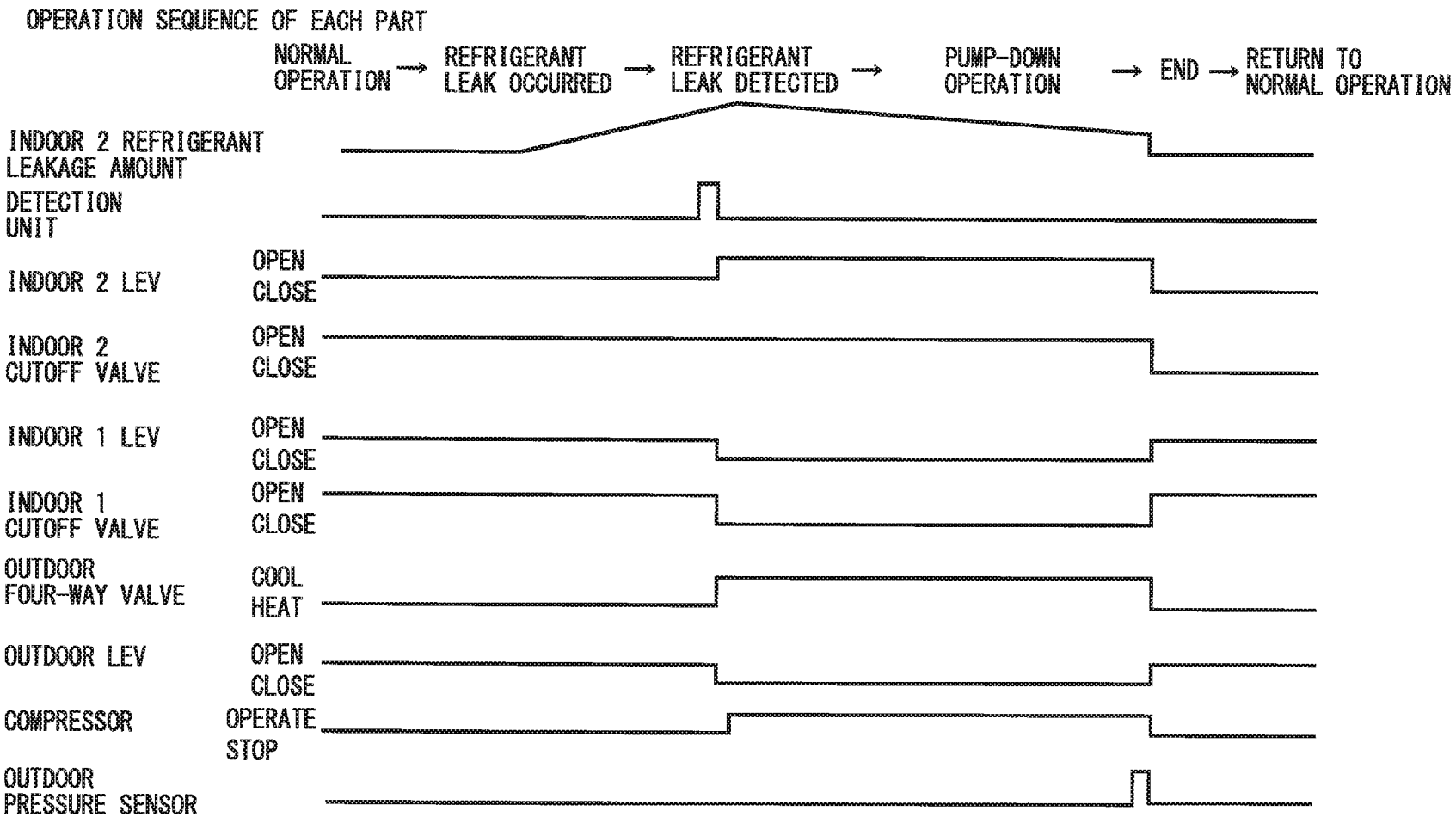
FIG. 4 is a timing chart illustrating exemplary operation of the air conditioner according to Embodiment 1 of the present invention.
Figure 5:
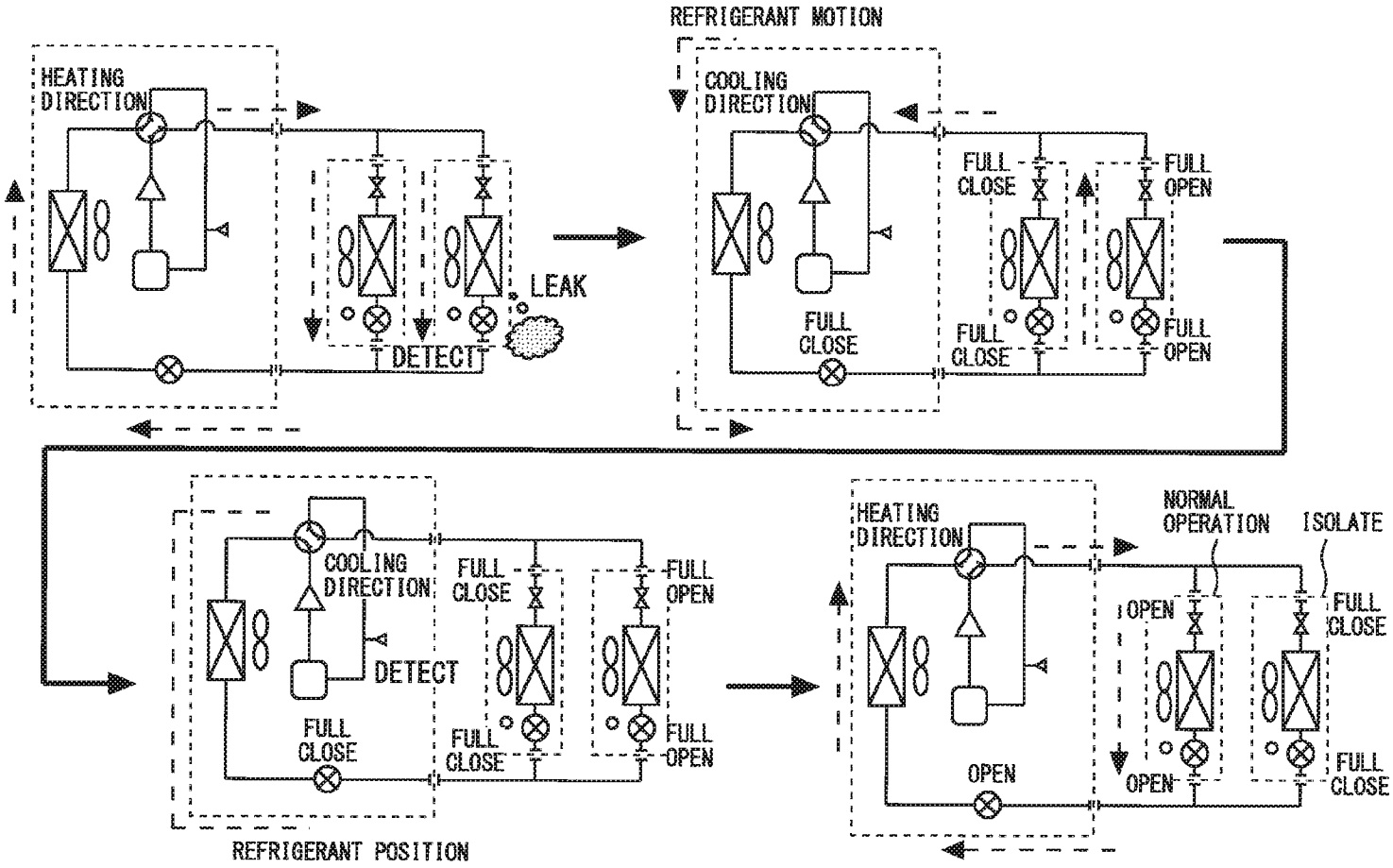
FIG. 5 is a diagram illustrating exemplary refrigerant motion in the air conditioner according to Embodiment 1 of the present invention.

FIGS. 1 to 5 relate to Embodiment 1 of the present invention. FIG. 1 is a diagram illustrating the entire configuration of a refrigerant circuit included in an air conditioner. FIG. 2 is a block diagram illustrating the configuration of a control system of the air conditioner. FIG. 3 is a flowchart illustrating exemplary operation of the air conditioner. FIG. 4 is a timing chart illustrating exemplary operation of the air conditioner. FIG. 5 is a diagram illustrating exemplary refrigerant motion in the air conditioner.

As illustrated in FIG. 1, the air conditioner according to Embodiment 1 of the present invention includes a first indoor unit 10*a*, a second indoor unit 10*b*, and an outdoor unit 20. The first indoor unit 10*a* and the second indoor unit 10*b* are installed inside a room as an air conditioning target. The outdoor unit 20 is installed outside the room. The first indoor unit 10*a* and the second indoor unit 10*b* may be installed inside an identical room or may be installed inside different rooms. The number of indoor units is two in this exemplary configuration described below, but may be equal to or larger than three.

The first indoor unit 10*a* includes a first indoor heat exchanger 11*a* and a first indoor unit fan 12*a*. The second indoor unit 10*b* includes a second indoor heat exchanger 11*b* and a second indoor unit fan 12*b*. The outdoor unit 20 includes an outdoor heat exchanger 21 and an outdoor unit fan 22.

The first indoor unit 10*a*, the second indoor unit 10*b*, and the outdoor unit 20 are connected by a refrigerant pipe 23. The refrigerant pipe 23 is provided to circulate between the first indoor heat exchanger 11*a* and the outdoor heat exchanger 21 and also circulate between the second indoor heat exchanger 11*b* and the outdoor heat exchanger 21. More specifically, the first indoor heat exchanger 11*a* and the second indoor heat exchanger 11*b* are connected in parallel by the refrigerant pipe 23. The outdoor heat exchanger 21 is connected in series to the first indoor heat exchanger 11*a* and the second indoor heat exchanger 11*b* by the refrigerant pipe 23.

It is desirable from the viewpoint of protection of the global environment that refrigerant enclosed in the refrigerant pipe 23 has a small global warming potential (GWP). The refrigerant enclosed in the refrigerant pipe 23 is combustible. The refrigerant has an average molecular weight larger than that of air. In other words, the refrigerant has a density higher than that of air and heavier than air under atmospheric pressure. Accordingly, the refrigerant has such a characteristic that the refrigerant moves downward in the direction of gravity in air.

Specifically, such refrigerant may be, for example, (mixed) refrigerant made of at least one refrigerant selected from among tetrafluoropropene (CF3CF═CH2:HFO-1234yf), difluoromethane (CH2F2:R32), propane (R290), propylene (R1270), ethane (R170), butane (R600), isobutane (R600a), 1.1.1.2-tetrafluoroethane (C2H2F4:R134a), pentafluoroethane (C2HF5:R125), 1.3.3.3-tetrafluoro-1-propene (CF3-CH═CHF:HFO-1234ze), and the like.

A compressor 25 is provided through a four-way valve 24 to the refrigerant pipe 23 on one side of a refrigerant circulation path between each of the first indoor heat exchanger 11*a* and the second indoor heat exchanger 11*b* and the outdoor heat exchanger 21. The compressor 25 is an instrument configured to compress supplied refrigerant to increase the pressure and temperature of the refrigerant. The compressor 25 may be, for example, a rotary compressor or a scroll compressor. In addition, an outdoor LEV 26 is provided in the refrigerant pipe 23 on the other side of the circulation path. The outdoor LEV 26 is a linear electric expansion valve. The outdoor LEV 26 expands refrigerant having flowed thereto to decrease the pressure and temperature of the refrigerant.

An accumulator 27 and a pressure sensor 28 are provided between the four-way valve 24 and the compressor 25. The pressure sensor 28 is a sensor configured to detect the pressure of refrigerant in the refrigerant pipe 23 on the side of the outdoor heat exchanger 21. The four-way valve 24, the compressor 25, the outdoor LEV 26, the accumulator 27, and the pressure sensor 28 are provided in the outdoor unit 20.

The refrigerant pipe 23 on the side of each of the first indoor unit 10*a* and the second indoor unit 10*b* and the refrigerant pipe 23 on the side of the outdoor unit 20 are connected through a metal connector such as a joint. Specifically, the refrigerant pipe 23 of the first indoor unit 10*a* is provided with a first indoor metal connector 13*a*. The refrigerant pipe 23 of the second indoor unit 10*b* is provided with a second indoor metal connector 13*b*. The refrigerant pipe 23 of the outdoor unit 20 is provided with an outdoor metal connector 29. The refrigerant pipe 23 on the side of each of the first indoor unit 10*a* and the second indoor unit 10*b* and the refrigerant pipe 23 on the side of the outdoor unit 20 are connected through the refrigerant pipe 23 between each of the first indoor metal connector 13*a* and the second indoor metal connector 13*b* and the outdoor metal connector 29 to form a refrigerant circulation path.

A refrigeration cycle (refrigerant circuit) is formed by the refrigerant circulation path formed by the refrigerant pipe 23, and the first indoor heat exchanger 11*a*, the second indoor heat exchanger 11*b*, the outdoor heat exchanger 21, the four-way valve 24, the compressor 25, the accumulator 27, and the outdoor LEV 26, which are connected on the circulation path by the refrigerant pipe 23.

As described above, the air conditioner according to the present embodiment includes the refrigerant circuit connecting the first indoor heat exchanger 11*a*, the second indoor heat exchanger 11*b*, and the outdoor heat exchanger 21 by the refrigerant pipe 23 in which refrigerant is enclosed. In the refrigerant circuit, the first indoor heat exchanger 11*a* and the second indoor heat exchanger 11*b* are connected in parallel, and the outdoor heat exchanger 21 is connected in series to these indoor heat exchangers. In other words, the first indoor heat exchanger 11*a* and the second indoor heat exchanger 11*b* share part of the refrigerant circuit on the side of the outdoor heat exchanger 21.

The refrigeration cycle thus configured functions as a heat pump configured to move heat between each of the first indoor unit 10*a* and the second indoor unit 10*b* and the outdoor unit 20 by performing heat exchange between refrigerant and air at each of the first indoor heat exchanger 11*a*, the second indoor heat exchanger 11*b*, and the outdoor heat exchanger 21. In this case, the direction in which the refrigerant is circulated in the refrigeration cycle can be inverted by switching the four-way valve 24 to perform switching between a cooling operation and a heating operation.

In the cooling operation, the first indoor unit 10*a* and the second indoor unit 10*b* both simultaneously perform cooling operations. Similarly, in the heating operation, the first indoor unit 10*a* and the second indoor unit 10*b* both simultaneously perform heating operations.

The first indoor unit 10*a* includes a first indoor LEV 14*a* and a first cutoff valve 15*a*. Two refrigerant pipes 23 are connected to the first indoor heat exchanger 11*a*. One of the two refrigerant pipes 23 is an outgoing path through which the refrigerant circulates toward the first indoor heat exchanger 11*a*, and the other is a returning path through which the refrigerant circulates back to the side of the outdoor heat exchanger 21. The first indoor LEV 14*a* is provided in one of the two refrigerant pipes 23 connected to the first indoor heat exchanger 11*a*, and the first cutoff valve 15*a* is provided in the other refrigerant pipe 23.

The first indoor LEV 14*a* and the first cutoff valve 15*a* can each close the refrigerant pipe 23 to cut off circulation of the refrigerant. The first indoor heat exchanger 11*a* can be completely isolated from the refrigerant circuit by closing both the first indoor LEV 14*a* and the first cutoff valve 15*a*. The first indoor LEV 14*a* and the first cutoff valve 15*a* are each an exemplary first isolator configured to be able to isolate the first indoor heat exchanger 11*a* from the refrigerant circuit.

The second indoor unit 10*b* includes a second indoor LEV 14*b* and a second cutoff valve 15*b*. Similarly to the first indoor heat exchanger 11*a*, two refrigerant pipes 23 are connected to the second indoor heat exchanger 11*b*. One of the two refrigerant pipes 23 is an outgoing path through which the refrigerant circulates toward the second indoor heat exchanger 11*b*, and the other is a returning path through which the refrigerant circulates back to the side of the outdoor heat exchanger 21.

The second indoor LEV 14*b* is provided in one of the two refrigerant pipes 23 connected to the second indoor heat exchanger 11*b*, and the second cutoff valve 15*b* is provided in the other refrigerant pipe 23.

The second indoor LEV 14*b* and the second cutoff valve 15*b* can each close the refrigerant pipe 23 to cut off circulation of the refrigerant. The second indoor heat exchanger 11*b* can be completely isolated from the refrigerant circuit by closing both the second indoor LEV 14*b* and the second cutoff valve 15*b*. The second indoor LEV 14*b* and the second cutoff valve 15*b* are each an exemplary second isolator configured to be able to isolate the second indoor heat exchanger 11*b* from the refrigerant circuit.

The first indoor unit 10*a*, the second indoor unit 10*b*, and the outdoor unit 20 each has a casing. A first indoor unit casing as the casing of the first indoor unit 10*a* houses the refrigerant pipe 23 in which refrigerant is enclosed, as well as the first indoor heat exchanger 11*a*, the first indoor unit fan 12*a*, the first indoor metal connector 13*a*, the first indoor LEV 14*a*, and the first cutoff valve 15*a*. Similarly, a second indoor unit casing as the casing of the second indoor unit 10*b* houses the refrigerant pipe 23 in which refrigerant is enclosed, as well as the second indoor heat exchanger 11*b*, the second indoor unit fan 12*b*, the second indoor metal connector 13*b*, the second indoor LEV 14*b*, and the second cutoff valve 15*b*. Similarly, the casing of the outdoor unit 20 houses the refrigerant pipe 23 in which refrigerant is enclosed, as well as the outdoor heat exchanger 21, the outdoor unit fan 22, the four-way valve 24, the compressor 25, the outdoor LEV 26, the accumulator 27, and the outdoor metal connector 29.

The following describes the operation of the air conditioner configured as described above in a normal operation, with an example of the cooling operation. The first indoor LEV 14*a*, the first cutoff valve 15*a*, the second indoor LEV 14*b*, and the second cutoff valve 15*b* are all opened when the cooling operation is simultaneously performed at both the first indoor unit 10*a* and the second indoor unit 10*b*. Then, the refrigerant flows inside the refrigerant pipe 23, and the first indoor unit fan 12*a*, the second indoor unit fan 12*b*, and the outdoor unit fan 22 rotate. The refrigerant in the refrigerant pipe 23 flows through the first indoor heat exchanger 11*a* and the second indoor heat exchanger 11*b* in a gas-liquid two-phase state at a temperature lower than indoor temperature.

While passing through the first indoor heat exchanger 11*a*, air sucked into the first indoor unit casing by the rotation of the first indoor unit fan 12*a* is cooled to a temperature lower than air temperature at the suction. Simultaneously, the refrigerant in the first indoor heat exchanger 11*a* is heated into gas and moves from the refrigerant pipe 23 to the outdoor unit 20. The air cooled while passing through the first indoor heat exchanger 11*a* is discharged from the first indoor unit casing into the room.

Similarly, while passing through the second indoor heat exchanger 11*b*, air sucked into the second indoor unit casing by the rotation of the second indoor unit fan 12*b* is cooed to a temperature lower than air temperature at the suction. Simultaneously, the refrigerant in the second indoor heat exchanger 11*b* is heated into gas and moves from the refrigerant pipe 23 to the outdoor unit 20. The air cooled while passing through the second indoor heat exchanger 11*b* is discharged from the second indoor unit casing into the room.

When the cooling operation is performed only by the first indoor unit 10*a*, the first indoor LEV 14*a* and the first cutoff valve are opened. In addition, one or both of the second indoor LEV 14*b* and the second cutoff valve 15*b* are closed. In this manner, the refrigerant flows only through the first indoor heat exchanger 11*a* but not through the second indoor heat exchanger 11*b*.

When the cooling operation is performed only by the second indoor unit 10*b*, the second indoor LEV 14*b* and the second cutoff valve are opened. In addition, one or both of the first indoor LEV 14*a* and the first cutoff valve 15*a* are closed. In this manner, the refrigerant flows only through the second indoor heat exchanger 11*b* but not through the first indoor heat exchanger 11*a*.

A first refrigerant leak sensor 30*a* is provided inside the first indoor unit casing described above. In addition, a second refrigerant leak sensor 30*b* is provided inside the second indoor unit casing described above. The first refrigerant leak sensor 30*a* and the second refrigerant leak sensor 30*b* can detect at least refrigerant of the same kind as refrigerant enclosed in the refrigerant pipe 23. The first refrigerant leak sensor 30*a* and the second refrigerant leak sensor 30*b* may be, for example, sensors of a contact combustion scheme, a semiconductor scheme, a heat conduction scheme, a low-potential electrolytic scheme, an infrared scheme, or the like.

Alternatively, the first refrigerant leak sensor 30*a* and the second refrigerant leak sensor 30*b* may be oxygen sensors. When the oxygen sensors are used, the concentration of inflow gas, in other words, the refrigerant can be indirectly detected by determining the concentration of oxygen based on a sensor output and calculating backward the concentration of the inflow gas based on an assumption that the amount of decrease in the concentration of oxygen is attributable to the inflow gas. The oxygen sensors may be, for example, of a galvanic battery scheme, a polarographic scheme, a zirconia scheme, or the like.

The air conditioner according to the present invention detects occurrence of refrigerant leak inside each of the above-described first indoor unit casing and the above-described second indoor unit casing by using results of detection by the first refrigerant leak sensor 30*a* and the second refrigerant leak sensor 30*b*. FIG. 2 illustrates the configuration of the control system of the air conditioner. As illustrated in the drawing, the air conditioner according to the present embodiment includes a leak detection unit 51, a storage unit 52, a notification unit 53, and a controller 54. These components are each configured by, for example, a circuit mounted on a control device of the air conditioner.

The leak detection unit 51 detects occurrence of refrigerant leak inside each of the above-described first indoor unit casing and the above-described second indoor unit casing based on results of detection by the first refrigerant leak sensor 30*a* and the second refrigerant leak sensor 30*b*. As described above, the first refrigerant leak sensor 30*a* and the second refrigerant leak sensor 30*b* can each directly or indirectly detect the refrigerant enclosed in the refrigerant pipe 23. Then, the first refrigerant leak sensor 30*a* and the second refrigerant leak sensor 30*b* each output a detection signal in accordance with the concentration of the detected refrigerant.

The detection signals output from the first refrigerant leak sensor 30*a* and the second refrigerant leak sensor 30*b* are input to the leak detection unit 51. The leak detection unit 51 first determines whether the refrigerant concentration indicated by the detection signal from each of the first refrigerant leak sensor 30*a* and the second refrigerant leak sensor 30*b* is equal to or higher than a leak determination reference value. The leak determination reference value is a value set in advance. The leak determination reference value set in advance is stored in the storage unit 52. The leak detection unit 51 performs the determination by comparing the leak determination reference value acquired from the storage unit 52 and the refrigerant concentration indicated by the detection signal from each of the first refrigerant leak sensor 30*a* and the second refrigerant leak sensor 30*b*.

When the refrigerant concentration indicated by the detection signal from the first refrigerant leak sensor 30*a* is equal to or higher than the leak determination reference value, the leak detection unit 51 outputs a first refrigerant leak detection signal to the controller 54. The first refrigerant leak detection signal is a signal indicating detection of refrigerant leak in the above-described first indoor unit casing. In this manner, the first refrigerant leak sensor 30*a* and the leak detection unit 51 function as a first leak detector configured to detect refrigerant leak in the above-described first indoor unit casing.

When the refrigerant concentration indicated by the detection signal from the second refrigerant leak sensor 30*b* is equal to or higher than the leak determination reference value, the leak detection unit 51 outputs a second refrigerant leak detection signal to the controller 54. The second refrigerant leak detection signal is a signal indicating detection of refrigerant leak in the above-described second indoor unit casing. In this manner, the second refrigerant leak sensor 30*b* and the leak detection unit 51 function as a second leak detector configured to detect refrigerant leak in the above-described second indoor unit casing.

An indoor side pressure sensor configured to detect the pressure in the refrigerant pipe 23 inside each of the above-described first indoor unit casing and the above-described second indoor unit casing may be provided in place of the corresponding one of the first refrigerant leak sensor 30*a* and the second refrigerant leak sensor 30*b* to detect refrigerant leak in the indoor unit casing. In this case, the leak detection unit 51 detects refrigerant leak, for example, when the indoor side pressure sensor has detected an abrupt pressure decrease.

The controller 54 controls the entire operation of the air conditioner by controlling an actuator included in the air conditioner. Exemplary targets of control by the controller 54 include the compressor 25, the four-way valve 24, the outdoor LEV 26, the first indoor LEV 14*a*, the second indoor LEV 14*b*, the first cutoff valve 15*a*, the second cutoff valve 15*b*, the first indoor unit fan 12*a*, the second indoor unit fan 12*b*, and the outdoor unit fan 22.

The controller 54 causes the air conditioner to perform a pump-down operation when one or both of the above-described first refrigerant leak detection signal and the above-described second refrigerant leak detection signal are input to the controller 54. The pump-down operation is an operation in which the refrigerant in the refrigerant circuit is collected to the side of the outdoor heat exchanger 21. Specifically, the side of the outdoor heat exchanger 21 includes, for example, the outdoor heat exchanger 21, the refrigerant pipe 23 between the outdoor heat exchanger 21 and the outdoor LEV 26, and the accumulator 27.

In the pump-down operation, the controller 54 operates the compressor 25 while the four-way valve 24 is set to a cooling direction and the outdoor LEV 26 is closed. Accordingly, the refrigerant on the side of each of the first indoor unit 10*a* and the second indoor unit 10*b* is sucked out to the compressor 25. Then, the high-temperature gas-phase refrigerant discharged from the compressor 25 is subjected to heat exchange with outdoor air while passing through the outdoor heat exchanger 21. The gas-phase refrigerant is liquefied by the heat exchange. The liquefied refrigerant leaves the outdoor heat exchanger 21 and reaches the outdoor LEV 26. Since the outdoor LEV 26 is closed, the liquid-phase refrigerant is collected to the inside of the refrigerant pipe 23 between the outdoor heat exchanger 21 and the outdoor LEV 26 and the outdoor heat exchanger 21. In this manner, the controller 54 performs the pump-down operation in which the refrigerant is collected to the side of the outdoor heat exchanger 21 when leak is detected by the above-described first leak detector or the above-described second leak detector.

In addition, in the air conditioner according to the present embodiment, when the above-described first refrigerant leak detection signal is input to the controller 54 and the above-described second refrigerant leak detection signal is not input to the controller 54, the controller 54 performs the pump-down operation while the second indoor LEV 14*b* and the second cutoff valve 15*b* are closed. In this case, the first indoor LEV 14*a* and the first cutoff valve 15*a* are fully opened. In other words, when the above-described first leak detector detects refrigerant leak and the above-described second leak detector does not detect refrigerant leak, the controller 54 isolates the second indoor heat exchanger 11*b* from the refrigerant circuit by the above-described second isolator in the pump-down operation.

In this manner, only the refrigerant on the side of the first indoor unit 10*a* at which refrigerant leak is detected can be collected to the side of the outdoor unit 20 while the refrigerant on the side of the second indoor unit 10*b* that is normal with no refrigerant leak detected is held at the second indoor heat exchanger 11*b*. Accordingly, the amount of collected refrigerant can be reduced so that a time necessary for the pump-down operation is reduced to complete the refrigerant collection in a shorter time.

When the above-described second refrigerant leak detection signal is input to the controller 54 and the above-described first refrigerant leak detection signal is not input to the controller 54, the controller 54 performs the pump-down operation while the first indoor LEV 14*a* and the first cutoff valve 15*a* are closed. In this case, the second indoor LEV 14*b* and the second cutoff valve 15*b* are fully opened. In other words, when the above-described second leak detector detects refrigerant leak and the above-described first leak detector does not detect refrigerant leak, the controller 54 isolates the first indoor heat exchanger 11*a* from the refrigerant circuit by the above-described first isolator in the pump-down operation.

In this manner, only the refrigerant on the side of the second indoor unit 10*b* at which refrigerant leak is detected can be collected to the side of the outdoor unit 20 while the refrigerant on the side of the first indoor unit 10*a* that is normal with no refrigerant leak detected is held at the first indoor heat exchanger 11*a*. Accordingly, the amount of collected refrigerant can be reduced so that a time necessary for the pump-down operation is reduced to complete the refrigerant collection in a shorter time.

The pressure on a suction side of the compressor 25 gradually decreases along with the refrigerant collection as the operation of the compressor 25 is continued in the pump-down operation. Thus, the controller 54 ends the pump-down operation when the pressure detected by the pressure sensor 28, in other words, the pressure of the refrigerant in the refrigerant pipe 23 on the side of the outdoor heat exchanger 21 has become equal to or lower than a pressure set in advance. A larger amount of refrigerant can be moved from the indoor side to the outdoor side by setting a threshold as the pressure beyond which the pump-down operation is ended to be as low as possible. Thus, the threshold as the pressure beyond which the pump-down operation is ended is preferably set to be a minimum pressure allowed for the operation of the compressor 25.

When the amount of refrigerant with which the air conditioner is filled is larger than the amount of refrigerant that can be held in the outdoor heat exchanger 21 and the refrigerant pipe 23 between the outdoor heat exchanger 21 and the outdoor LEV 26, the refrigerant cannot be completely collected. Thus, the controller 54 preferably performs processing as described below, for example, when a time set in advance has elapsed since the pump-down operation is started but the pressure detected by the pressure sensor 28 has not become equal to or lower than the above-described pressure set in advance.

Specifically, in this case, the controller 54 changes the four-way valve 24 to a heating direction and continues the operation of the compressor 25. In this manner, liquid-phase refrigerant that cannot be held by the outdoor heat exchanger 21 and the like can be moved to and accumulated in the accumulator 27. Then, when the liquid refrigerant in the outdoor heat exchanger 21 and the refrigerant pipe 23 between the outdoor heat exchanger 21 and the outdoor LEV 26 is gone, the four-way valve 24 can be returned to the cooling direction to collect refrigerant again.

After the refrigerant pump-down operation is ended in this manner, the air conditioning operation can be resumed at an indoor unit at which refrigerant leak is not detected. Specifically, when the above-described first refrigerant leak detection signal is input to the controller 54 and the above-described second refrigerant leak detection signal is not input to the controller 54, the controller 54 closes the first indoor LEV 14*a* and the first cutoff valve 15*a* after the pump-down operation is ended. In addition, the controller 54 fully opens the second indoor LEV 14*b* and the second cutoff valve 15*b*. Then, the controller 54 resumes the operation of the compressor 25 and the like and resumes the air conditioning operation only by the second indoor unit 10*b*.

Specifically, when the above-described first leak detector detects refrigerant leak and the above-described second leak detector does not detect refrigerant leak, the controller 54 connects the second indoor heat exchanger 11*b* to the refrigerant circuit and isolates the first indoor heat exchanger 11*a* from the refrigerant circuit by the above-described first isolator after the pump-down operation is ended, and then resumes circulation of the refrigerant. In this manner, since the first indoor heat exchanger 11*a* of the first indoor unit 10*a* at which refrigerant leak is detected is separated from the refrigerant circuit, the refrigerant can be circulated only through the remaining normal refrigerant circuit while further refrigerant leak is prevented. Accordingly, the operation can be continued only with the second indoor unit 10*b* at which refrigerant leak is not detected.

When the above-described second refrigerant leak detection signal is input to the controller 54 and the above-described first refrigerant leak detection signal is not input to the controller 54, the controller 54 closes the second indoor LEV 14*b* and the second cutoff valve 15*b* after the pump-down operation is ended. In addition, the controller 54 fully opens the first indoor LEV 14*a* and the first cutoff valve 15*a*. Then, the controller 54 resumes the operation of the compressor 25 and the like and resumes the air conditioning operation only by the first indoor unit 10*a*.

Specifically, when the above-described second leak detector detects refrigerant leak and the above-described first leak detector does not detect refrigerant leak, the controller 54 connects the first indoor heat exchanger 11*a* to the refrigerant circuit and isolates the second indoor heat exchanger 11*b* from the refrigerant circuit by the above-described second isolator after the pump-down operation is ended, and then resumes circulation of the refrigerant. In this manner, while the second indoor heat exchanger 11*b* of the second indoor unit 10*b* at which refrigerant leak is detected is separated from the refrigerant circuit, the operation can be continued only by the first indoor unit 10*a* at which refrigerant leak is not detected.

When a refrigerant leak detection signal is output from the leak detection unit 51, the notification unit 53 notifies a user, a worker, or the like of the output to prompt ventilation, repair, and the like. The notification unit 53 includes, for example, a speaker or an LED for giving, by sound or light, notification that occurrence of refrigerant leak at one or both of the above-described first and second indoor unit casings is detected.

The following describes, with reference to FIGS. 3 to 5, exemplary operation of the air conditioner configured as described above when refrigerant leak occurs at the second indoor unit 10*b* in the heating operation. First, when the air conditioner simultaneously starts the heating operation at the first indoor unit 10*a* and the second indoor unit 10*b*, the first indoor LEV 14*a* and the second indoor LEV 14*b* are each opened at the opening degree in accordance with the contents of the operation as illustrated at "normal operation" in FIG. 4. In addition, the first cutoff valve 15*a*, the second cutoff valve 15*b*, and the outdoor LEV 26 are opened. The four-way valve 24 is set to the heating direction.

When refrigerant leak occurs at the second indoor heat exchanger 11*b* of the second indoor unit 10*b* in this operation (the upper-left part in FIG. 5), the amount of refrigerant leak gradually increases as illustrated in FIG. 4. Then, when the amount of refrigerant leak becomes equal to or larger than a reference amount, the leak detection unit 51 detects occurrence of refrigerant leak in the above-described second indoor unit casing based on a detection signal from the second refrigerant leak sensor 30*b* at step S1 in FIG. 3 ("refrigerant leak detection" in FIG. 4). After step S1, the processing proceeds to step S2.

At step S2, the controller 54 closes the outdoor LEV 26. After step S2, the processing proceeds to step S3. At step S3, the controller 54 switches the four-way valve 24 to the cooling direction. In this example, the direction of the four-way valve 24 is switched since refrigerant leak occurs in the heating operation, but the direction of the four-way valve 24 does not need to be switched in the cooling operation. After step S3, the processing proceeds to step S4.

At step S4, the controller 54 closes the first indoor LEV 14*a* and the first cutoff valve 15*a* of an indoor unit at which refrigerant leak is not detected, in other words, the first indoor unit 10*a* in this example. The second indoor LEV 14*b* and the second cutoff valve 15*b* of the second indoor unit 10*b* at which refrigerant leak is detected are kept opened. Since, in the example illustrated in FIG. 4, the opening degree of the second indoor LEV 14*b* is not fully opened in the normal operation, the opening degree of the second indoor LEV 14*b* is fully opened at step S4. After step S4, the processing proceeds to step S5.

At step S5, the controller 54 operates the compressor 25 to start the refrigerant pump-down operation (the upper-right part in FIG. 5). After step S5, the processing proceeds to step S6. The refrigerant is collected to the side of the outdoor heat exchanger 21 by the pump-down operation as illustrated at the lower-left part in FIG. 5. Then, when the pressure detected by the pressure sensor 28 becomes equal to or lower than the above-described pressure set in advance at step S6, the processing proceeds to step S7.

At step S7, the controller 54 closes the second indoor LEV 14*b* and the second cutoff valve 15*b* of an indoor unit at which refrigerant leak is detected, in other words, the second indoor unit 10*b* in this example. After step S7, the processing proceeds to step S8. At step S8, the controller 54 opens the first indoor LEV 14*a* and the first cutoff valve 15*a* of an indoor unit at which refrigerant leak is not detected, in other words, the first indoor unit 10*a* in this example. When the processing at step S8 is completed, the series of operations of the pump-down operation are ended.

When the pump-down operation is ended, the controller 54 switches the four-way valve 24 to the heating direction. Then, the first indoor unit 10*a* at which refrigerant leak is not detected returns to the normal operation. In a state after the return, the second indoor heat exchanger 11*b* of the second indoor unit 10*b* is isolated from the refrigerant circuit by the above-described second isolator (the lower-right part in FIG. 5).

When the first indoor LEV 14*a* and the first cutoff valve 15*a* are closed while refrigerant leak occurs at the first indoor heat exchanger 11*a*, the refrigerant between the first indoor LEV 14*a* and the first cutoff valve 15*a* leaks. Thus, the first indoor LEV 14*a* and the first cutoff valve 15*a* are preferably provided before and after the first indoor heat exchanger 11*a* and as close to the first indoor heat exchanger 11*a* as possible. This is same for the second indoor LEV 14*b* and the second cutoff valve 15*b*.

Embodiment 2

Figure 6:
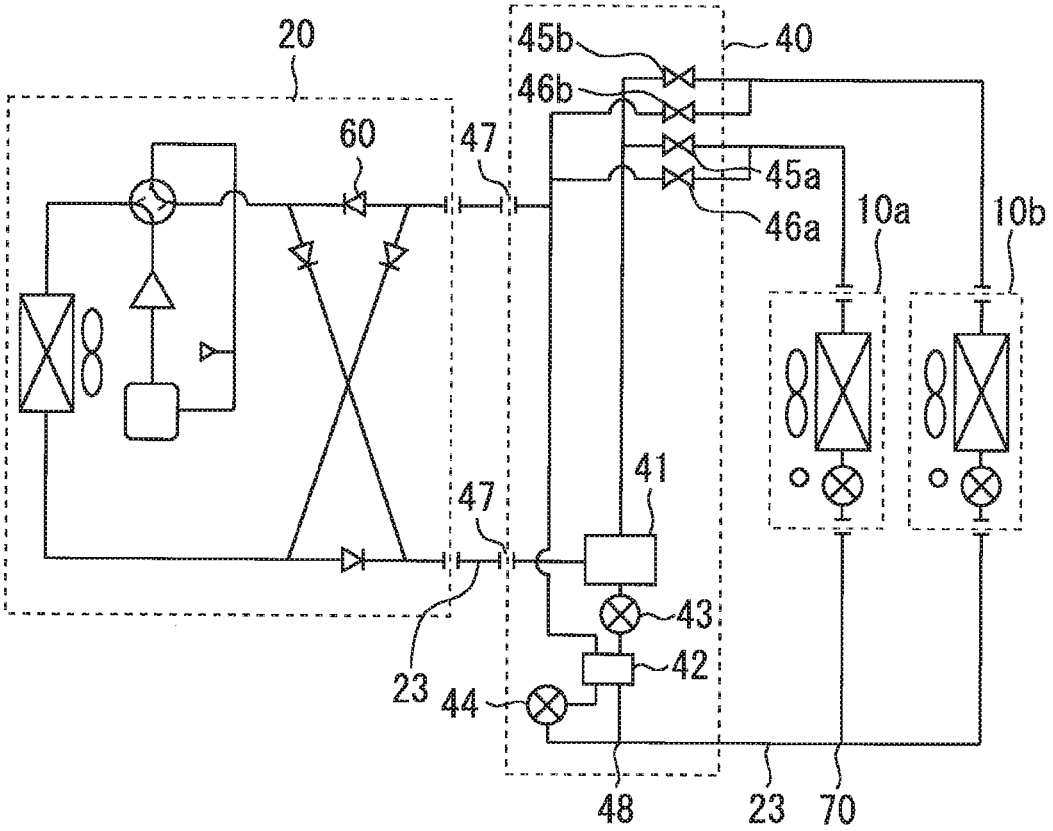
FIG. 6 is a diagram illustrating the entire configuration of a refrigerant circuit included in an air conditioner according to Embodiment 2 of the present invention.
Figure 8:
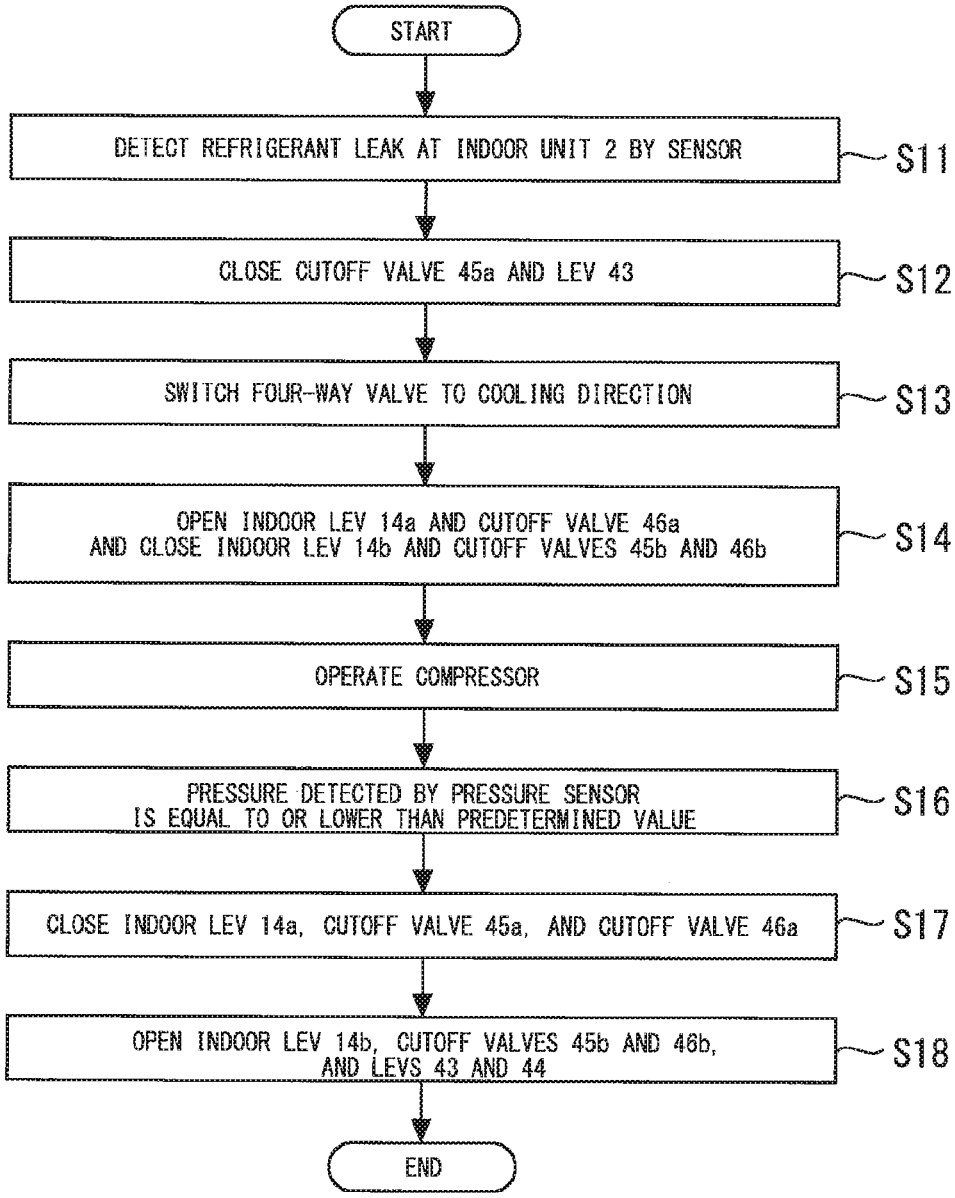
FIG. 8 is a flowchart illustrating exemplary operation of the air conditioner according to Embodiment 2 of the present invention.

FIGS. 6 to 8 relate to Embodiment 2 of the present invention. FIG. 6 is a diagram illustrating the entire configuration of a refrigerant circuit included in an air conditioner. FIG. 7 is a diagram illustrating the opened or closed state of each valve of a relay unit included in the air conditioner. FIG. 8 is a flowchart illustrating exemplary operation of the air conditioner.

In Embodiment 1 described above, a plurality of indoor units can simultaneously perform operation of the same kind only. In other words, for example, the second indoor unit 10*b* can perform only the cooling operation when the first indoor unit 10*a* performs the cooling operation. In addition, the second indoor unit 10*b* can perform only the heating operation when the first indoor unit 10*a* performs the heating operation. The same relation applies to the operation of the first indoor unit during the operation of the second indoor unit. However, in Embodiment 2 described below, a plurality of indoor units can simultaneously perform operations of different kinds, in other words, what is called a cooling-heating simultaneous operation can be performed. The following description will be made mainly on difference of the air conditioner according to Embodiment 2 from that of Embodiment 1. Any component, description of which is omitted is basically same as that in Embodiment 1.

The air conditioner according to the present embodiment includes a relay unit 40 in addition to the first indoor unit 10*a*, the second indoor unit 10*b*, and the outdoor unit 20 as illustrated in FIG. 6. The number of indoor units is two in an exemplary configuration described below, but, similarly to Embodiment 1, the number of indoor units may be equal to or larger than three.

The outdoor unit 20 in the present embodiment includes a check valve 60. Through the check valve 60, the refrigerant constantly flows in one of the two refrigerant pipes 23 connected to the outdoor unit 20 in the direction in which the refrigerant flows into the outdoor unit 20, and the refrigerant constantly flows in the other refrigerant pipe in the direction in which the refrigerant flows out of the outdoor unit 20.

The relay unit 40 is connected to the refrigerant pipe 23 between each of the first indoor unit 10*a* and the second indoor unit 10*b* and the outdoor unit 20. The relay unit 40 is connected to the refrigerant pipe 23 on the side of the outdoor unit 20 through a relay metal connector 47. The relay unit 40 is also connected to the refrigerant pipe 23 on the side of each of the first indoor unit 10*a* and the second indoor unit 10*b*.

The relay unit 40 includes a gas-liquid separator 41 and a relay heat exchanger 42. The gas-liquid separator 41 is connected to the refrigerant pipe 23 through which the refrigerant flows out of the outdoor unit 20. The gas-liquid separator 41 separates the refrigerant in mixture of gas-phase and liquid-phase states into liquid-phase refrigerant and gas-phase refrigerant. The gas-liquid separator 41 is also connected to a liquid-side pipe through which the separated liquid-phase refrigerant flows out and a gas-side pipe through which the separated gas-phase refrigerant flows out.

The liquid-side pipe of the gas-liquid separator 41 passes through the relay heat exchanger 42 via a first relay LEV 43 and is connected to a relay trifurcate part 48. One of pipes bifurcated at the relay trifurcate part 48 passes through the relay heat exchanger 42 via a second relay LEV 44 and is connected to the refrigerant pipe 23 through which the refrigerant flows into the outdoor unit 20. The relay heat exchanger 42 performs heat exchange between the refrigerant having passed through the first relay LEV 43 and the refrigerant having passed through the second relay LEV 44.

The other of the pipes bifurcated at the relay trifurcate part 48 is connected to the refrigerant pipe 23 on the side of each of the first indoor unit 10*a* and the second indoor unit 10*b*. The refrigerant pipe 23 extending from the relay trifurcate part 48 is bifurcated at an indoor side trifurcate part 70 and connected to the first indoor heat exchanger 11*a* and the second indoor heat exchanger 11*b*. Similarly to Embodiment 1, the first indoor LEV 14*a* is provided in the refrigerant pipe 23 on the side of the relay trifurcate part 48 of the first indoor heat exchanger 11*a*. Similarly to Embodiment 1, the second indoor LEV 14*b* is provided in the refrigerant pipe 23 on the side of the relay trifurcate part 48 of the second indoor heat exchanger 11*b*.

The relay unit 40 includes a first relay cutoff valve 45*a*, a second relay cutoff valve 45*b*, a third relay cutoff valve 46*a*, and a fourth relay cutoff valve 46*b*. The gas-side pipe of the gas-liquid separator 41 is bifurcated into two. One of the bifurcated pipes is connected to the first indoor heat exchanger 11*a* through the first relay cutoff valve 45*a*. The other is connected to the second indoor heat exchanger 11*b* through the second relay cutoff valve 45*b*.

The first relay cutoff valve 45*a* and the second relay cutoff valve 45*b* can cut off circulation of the refrigerant by closing pipes. When the first relay cutoff valve 45*a* and the second relay cutoff valve 45*b* are opened, the refrigerant can pass through these cutoff valves in the direction in which the refrigerant flows out of the relay unit 40.

A pipe is bifurcated from a pipe between the first relay cutoff valve 45*a* and the first indoor heat exchanger 11*a*. The bifurcated pipe is connected through the third relay cutoff valve 46*a* to the refrigerant pipe 23 through which the refrigerant flows into the outdoor unit 20. A pipe is bifurcated from a pipe between the second relay cutoff valve 45*b* and the second indoor heat exchanger 11*b*. The bifurcated pipe is connected through the fourth relay cutoff valve 46*b* to the refrigerant pipe 23 through which the refrigerant flows into the outdoor unit 20.

The third relay cutoff valve 46*a* and the fourth relay cutoff valve 46*b* can cut off circulation of the refrigerant by closing pipes. When the third relay cutoff valve 46*a* and the fourth relay cutoff valve 46*b* are opened, the refrigerant can pass through these cutoff valves in the direction in which the refrigerant flows into the relay unit 40.

The first indoor heat exchanger 11*a* can be completely isolated from the refrigerant circuit by closing the first indoor LEV 14*a*, the first relay cutoff valve 45*a*, and the third relay cutoff valve 46*a*. The first indoor LEV 14*a*, the first relay cutoff valve 45*a*, and the third relay cutoff valve 46*a* in the present embodiment function as a first isolator configured to be able to isolate the first indoor heat exchanger 11*a* from the refrigerant circuit.

The second indoor heat exchanger 11*b* can be completely isolated from the refrigerant circuit by closing the second indoor LEV 14*b*, the second relay cutoff valve 45*b*, and the fourth relay cutoff valve 46*b*. The second indoor LEV 14*b*, the second relay cutoff valve 45*b*, and the fourth relay cutoff valve 46*b* in the present embodiment function as a second isolator configured to be able to isolate the second indoor heat exchanger 11*b* from the refrigerant circuit.

The first cutoff valve 15*a* and the second cutoff valve 15*b*, which are provided in Embodiment 1, are not provided in Embodiment 2. In the present embodiment, without providing the first cutoff valve 15*a* and the second cutoff valve 15*b* to the first indoor unit 10*a* and the second indoor unit 10*b*, the above-described first and second isolators can be configured by using the first relay cutoff valve 45*a*, the second relay cutoff valve 45*b*, the third relay cutoff valve 46*a*, and the fourth relay cutoff valve 46*b* included in the relay unit 40.

The following describes operation of the air conditioner configured as described above in the normal operation with reference to FIGS. 6 and 7. In a table in FIG. 7, a circle indicates that the corresponding valve is opened, and a cross indicates that the corresponding valve is closed.

The air conditioner according to the present embodiment can perform a full cooling operation, a full heating operation, and a cooling-heating simultaneous operation. The full cooling operation is an operation in which cooling is performed at both the first indoor unit 10*a* and the second indoor unit 10*b*. The full heating operation is an operation in which heating is performed at both the first indoor unit 10*a* and the second indoor unit 10*b*. The cooling-heating simultaneous operation is an operation in which cooling is performed at one of the first indoor unit 10*a* and the second indoor unit 10*b* and heating is performed at the other. Accordingly, it is possible to optionally select whether to perform cooling or heating at each of the first indoor unit 10*a* and the second indoor unit 10*b*.

First, the full cooling operation is described below. In the full cooling operation, as illustrated in FIG. 7, the first relay cutoff valve 45*a* and the second relay cutoff valve 45*b* are closed, and the third relay cutoff valve 46*a* and the fourth relay cutoff valve 46*b* are opened. The high-temperature and high-pressure gas refrigerant compressed at the compressor 25 flows into the outdoor heat exchanger 21 through the four-way valve 24. The refrigerant having passed through the outdoor heat exchanger 21 is liquefied by heat exchange. The refrigerant flowing out of the outdoor unit 20 all has a liquid phase. Accordingly, the refrigerant having flowed from the outdoor unit 20 into the gas-liquid separator 41 of the relay unit 40 all circulates to the first relay LEV 43. The refrigerant is depressurized to middle pressure at the first relay LEV 43 and the supercooling degree thereof is increased at the relay heat exchanger 42 before the refrigerant reaches the relay trifurcate part 48.

Then, the refrigerant is bifurcated at the relay trifurcate part 48, and part thereof passes through the second relay LEV 44 and flows out of the relay unit 40. The refrigerant is evaporated and vaporized through heat exchange while passing through the relay heat exchanger 42. The refrigerant bifurcated at the relay trifurcate part 48 and having flowed out of the relay unit 40 flows into each of the first indoor unit 10*a* and the second indoor unit 10*b*.

The refrigerant is depressurized at the first indoor LEV 14*a* and the second indoor LEV 14*b* of the first indoor unit 10*a* and the second indoor unit 10*b* and then subjected to heat exchange with air in a target room at the first indoor heat exchanger 11*a* and the second indoor heat exchanger 11*b*. The refrigerant is evaporated and vaporized by cooling air in the target room and flows out of the first indoor heat exchanger 11*a* and the second indoor heat exchanger 11*b*. Accordingly, the inside of the target room is cooled.

The refrigerant flows out of the first indoor unit 10*a* and the second indoor unit 10*b* and flows into the relay unit 40 again. The refrigerant having flowed into the relay unit 40 passes through the third relay cutoff valve 46*a* and the fourth relay cutoff valve 46*b*, which have been opened, and flows out of the relay unit 40. The refrigerant having flowed out of the relay unit 40 flows into the outdoor unit 20. The refrigerant having flowed into the outdoor unit 20 passes through the check valve 60 and is sucked into the compressor 25 via the accumulator 27. In this manner, the refrigerant circulates through the refrigerant circuit.

The full heating operation is described below. In the full heating operation, as illustrated in FIG. 7, the first relay cutoff valve 45*a* and the second relay cutoff valve 45*b* are opened, and the third relay cutoff valve 46*a* and the fourth relay cutoff valve 46*b* are closed. The high-temperature and high-pressure gas refrigerant compressed at the compressor 25 passes through the four-way valve 24 and the outdoor heat exchanger 21 and flows out of the outdoor unit 20. The refrigerant flowing out of the outdoor unit 20 all has a gas phase. Accordingly, the refrigerant having flowed from the outdoor unit 20 into the gas-liquid separator 41 of the relay unit 40 all passes through the first relay cutoff valve 45*a* and the second relay cutoff valve 45*b* and flows out of the relay unit 40.

The refrigerant having flowed out of the relay unit 40 flows into the first indoor unit 10*a* and the second indoor unit 10*b*. The refrigerants having flowed into the first indoor unit 10*a* and the second indoor unit 10*b* are subjected to heat exchange with air in the target room at the first indoor heat exchanger 11*a* and the second indoor heat exchanger 11*b*, and condensed and liquefied while releasing heat. Accordingly, the inside of the target room is heated.

The refrigerants having passed through the first indoor heat exchanger 11*a* and the second indoor heat exchanger 11*b* pass through the first indoor LEV 14*a* and the second indoor LEV 14*b* and flow out of the first indoor unit 10*a* and the second indoor unit 10*b*. The refrigerants having flowed out of the first indoor unit 10*a* and the second indoor unit 10*b* join at the indoor side trifurcate part 70 and flow into the relay unit 40. The refrigerant flowed into the relay unit 40 passes through the relay heat exchanger 42 via the relay trifurcate part 48 and the second relay LEV 44. The refrigerant having passed through the relay heat exchanger 42 flows out of the relay unit 40 and returns to the outdoor unit 20.

Lastly, the cooling-heating simultaneous operation is described below. The following describes a case in which the first indoor unit 10*a* performs the heating operation and the second indoor unit 10*b* performs the cooling operation. In this case, as illustrated in FIG. 7, the first relay cutoff valve 45*a* and the fourth relay cutoff valve 46*b* are opened, and the second relay cutoff valve 45*b* and the third relay cutoff valve 46*a* are closed.

The high-temperature and high-pressure gas refrigerant compressed at the compressor 25 flows into the outdoor heat exchanger 21 through the four-way valve 24. Part of the refrigerant passing through the outdoor heat exchanger 21 is liquefied by heat exchange. Accordingly, the gas-liquid two-phase refrigerant flows out of the outdoor heat exchanger 21. The refrigerant having flowed from the outdoor unit 20 into the relay unit 40 is separated into gas-phase refrigerant and liquid-phase refrigerant at the gas-liquid separator 41.

The gas-phase refrigerant separated at the gas-liquid separator 41 passes through the open first relay cutoff valve 45*a* and flows out of the relay unit 40, and then flows into the first indoor unit 10*a*. The refrigerant having flowed into the first indoor unit 10*a* is subjected to heat exchange with air in the target room at the first indoor heat exchanger 11*a*, and condensed and liquefied while releasing heat. Accordingly, the inside of the target room is heated. The refrigerant having passed through the first indoor heat exchanger 11*a* passes through the first indoor LEV 14*a* and flows out of the first indoor unit 10*a*.

The liquid-phase refrigerant separated at the gas-liquid separator 41 is depressurized to middle pressure at the first relay LEV 43 and the supercooling degree thereof is increased at the relay heat exchanger 42 before the refrigerant reaches the relay trifurcate part 48. Then, the refrigerant is bifurcated at the relay trifurcate part 48, and part thereof passes through the second relay LEV 44 and the relay heat exchanger 42. The refrigerant having passed through the relay heat exchanger 42 absorbs heat by heat exchange and is returned to the outdoor unit 20 while being evaporated and vaporized.

The other refrigerant bifurcated at the relay trifurcate part 48 joins with the refrigerant having flowed out of the first indoor unit 10*a* at the indoor side trifurcate part 70, and flows into the second indoor unit 10*b*. The refrigerant having flowed into the second indoor unit 10*b* is depressurized at the second indoor LEV 14*b* and then subjected to heat exchange with air in the target room at the second indoor heat exchanger 11*b*. The refrigerant is evaporated and vaporized while cooling air in the target room and flows out of the second indoor heat exchanger 11*b*. Accordingly, the inside of the target room is cooled.

The refrigerant having passed through the second indoor heat exchanger 11*b* flows out of the second indoor unit 10*b* and flows into the relay unit 40 again. The refrigerant having flowed into the relay unit 40 passes through the open fourth relay cutoff valve 46*b* and flows out of the relay unit 40. The refrigerant having flowed out of the relay unit 40 flows into the outdoor unit 20. In this manner, the refrigerant circulates through the refrigerant circuit.

When the first indoor unit 10*a* performs the cooling operation and the second indoor unit 10*b* performs the heating operation, the first relay cutoff valve 45*a* and the fourth relay cutoff valve 46*b* are closed, and the second relay cutoff valve 45*b* and the third relay cutoff valve 46*a* are opened as illustrated in FIG. 7.

In Embodiment 2 as well, when one or both of the above-described first refrigerant leak detection signal and the above-described second refrigerant leak detection signal in Embodiment 1 are input to the controller 54, the controller 54 causes the air conditioner to perform the pump-down operation.

In the pump-down operation, the controller 54 switches the four-way valve 24 to the cooling direction and operates the compressor 25 while the first relay LEV 43 and the second relay LEV 44 are closed. Accordingly, the refrigerant on the side of each of the first indoor unit 10*a* and the second indoor unit 10*b* is sucked out to the compressor 25. Then, the refrigerant discharged from the compressor 25 is liquefied while passing through the outdoor heat exchanger 21. The liquefied refrigerant flows out of the outdoor unit 20 and flows into the relay unit 40. The liquid-phase refrigerant having flowed into the relay unit 40 flows from the gas-liquid separator 41 to the side of the first relay LEV 43. Since the first relay LEV 43 is closed in the pump-down operation, the refrigerant is collected to the inside of the relay unit 40 on the outdoor unit 20 side of the first relay LEV 43 and the inside of the outdoor unit 20. In this manner, the controller 54 performs the pump-down operation in which the refrigerant is collected to the side of the outdoor heat exchanger 21 when leak is detected by the above-described first leak detector or the above-described second leak detector.

In addition, in the air conditioner according to the present embodiment, when the above-described first refrigerant leak detection signal is input to the controller 54 and the above-described second refrigerant leak detection signal is not input to the controller 54, the controller 54 performs the pump-down operation while the second indoor LEV 14*b*, the first relay cutoff valve 45*a*, the second relay cutoff valve 45*b*, and the fourth relay cutoff valve 46*b* are closed as illustrated in FIG. 7. In this case, the first indoor LEV 14*a* and the third relay cutoff valve 46*a* are fully opened. Since the third relay cutoff valve 46*a* is fully opened in the pump-down operation, the refrigerant in the first indoor heat exchanger 11*a* can pass through the third relay cutoff valve 46*a* and the relay unit 40 and can be collected to the side of the outdoor unit 20.

In this manner, when the above-described first leak detector detects refrigerant leak and the above-described second leak detector does not detect refrigerant leak, the controller 54 isolates the second indoor heat exchanger 11*b* from the refrigerant circuit by the above-described second isolator in the pump-down operation. Thus, only the refrigerant on the side of the first indoor unit 10*a* at which refrigerant leak is detected can be collected to the side of the outdoor unit 20 while the refrigerant on the side of the second indoor unit 10*b* that is normal with no refrigerant leak detected is held at the second indoor heat exchanger 11*b*. Accordingly, the amount of collected refrigerant can be reduced so that a time necessary for the pump-down operation is reduced to complete the refrigerant collection in a shorter time.

When the above-described second refrigerant leak detection signal is input to the controller 54 and the above-described first refrigerant leak detection signal is not input to the controller 54, the controller 54 performs the pump-down operation while the first indoor LEV 14*a*, the first relay cutoff valve 45*a*, the second relay cutoff valve 45*b*, and the third relay cutoff valve 46*a* are closed as illustrated in FIG. 7. In this case, the second indoor LEV 14*b* and the fourth relay cutoff valve 46*b* are fully opened. Since the fourth relay cutoff valve 46*b* is fully opened in the pump-down operation, the refrigerant in the second indoor heat exchanger 11*b* can pass through the fourth relay cutoff valve 46*b* and flow from the relay unit 40 to the outdoor unit 20, and thus can be collected to the side of the outdoor unit 20.

In this manner, when the above-described second leak detector detects refrigerant leak and the above-described first leak detector does not detect refrigerant leak, the controller 54 isolates the first indoor heat exchanger 11*a* from the refrigerant circuit by the above-described first isolator in the pump-down operation. Thus, only the refrigerant on the side of the second indoor unit 10*b* at which refrigerant leak is detected can be collected to the side of the outdoor unit 20 while the refrigerant on the side of the first indoor unit 10*a* that is normal with no refrigerant leak detected is held at the first indoor heat exchanger 11*a*. Accordingly, the amount of collected refrigerant can be reduced so that a time necessary for the pump-down operation is reduced to complete the refrigerant collection in a shorter time.

After the refrigerant pump-down operation is ended in this manner, the air conditioning operation can be resumed at the indoor unit at which refrigerant leak is not detected. Specifically, when the above-described first refrigerant leak detection signal is input to the controller 54 and the above-described second refrigerant leak detection signal is not input to the controller 54, the controller 54 closes the first indoor LEV 14*a*, the first relay cutoff valve 45*a*, and the third relay cutoff valve 46*a* after the pump-down operation is ended. In addition, the controller 54 opens the second relay LEV 44, the second relay cutoff valve 45*b*, and the fourth relay cutoff valve 46*b*. Then, the controller 54 resumes the operation of the compressor 25 and the like and resumes the air conditioning operation only by the second indoor unit 10*b*.

Specifically, when the above-described first leak detector detects refrigerant leak and the above-described second leak detector does not detect refrigerant leak, the controller 54 connects the second indoor heat exchanger 11*b* to the refrigerant circuit and isolates the first indoor heat exchanger 11*a* from the refrigerant circuit by the above-described first isolator after the pump-down operation is ended, and then resumes circulation of the refrigerant. In this manner, since the first indoor heat exchanger 11*a* of the first indoor unit 10*a* at which refrigerant leak is detected is separated from the refrigerant circuit, refrigerant can be circulated only through the remaining normal refrigerant circuit while further refrigerant leak is prevented. Accordingly, the operation can be continued only with the second indoor unit 10*b* at which refrigerant leak is not detected.

When the above-described second refrigerant leak detection signal is input to the controller 54 and the above-described first refrigerant leak detection signal is not input to the controller 54, the controller 54 closes the second indoor LEV 14*b*, the second relay cutoff valve 45*b*, and the fourth relay cutoff valve 46*b* after the pump-down operation is ended. In addition, the controller 54 opens the first indoor LEV 14*a*, the first relay cutoff valve 45*a*, and the third relay cutoff valve 46*a*. Then, the controller 54 resumes the operation of the compressor 25 and the like and resumes the air conditioning operation only by the first indoor unit 10*a*.

Specifically, when the above-described second leak detector detects refrigerant leak and the above-described first leak detector does not detect refrigerant leak, the controller 54 connects the first indoor heat exchanger 11*a* to the refrigerant circuit and isolates the second indoor heat exchanger 11*b* from the refrigerant circuit by the above-described second isolator after the pump-down operation is ended, and then resumes circulation of the refrigerant. In this manner, while the second indoor heat exchanger 11*b* of the second indoor unit 10*b* at which refrigerant leak is detected is separated from the refrigerant circuit, the operation can be continued only by the first indoor unit 10*a* at which refrigerant leak is not detected.

The following describes, with reference to FIG. 8, exemplary operation of the air conditioner configured as described above, with an example in which refrigerant leak occurs at the first indoor unit 10*a*. When refrigerant leak occurs at the first indoor heat exchanger 11*a* of the first indoor unit 10*a* in operation, the leak detection unit 51 detects the occurrence of refrigerant leak in the above-described first indoor unit casing based on the detection signal from the first refrigerant leak sensor 30*a* at step S11. After step S11, the processing proceeds to step S12.

At step S12, the controller 54 closes the first relay cutoff valve 45*a*, the first relay LEV 43, and the second relay LEV 44. After step S12, the processing proceeds to step S13. At step S13, the controller 54 switches the four-way valve 24 to the cooling direction. After step S13, the processing proceeds to step S14.

At step S14, the controller 54 opens the first indoor LEV 14*a* and the third relay cutoff valve 46*a*. In addition, the controller 54 closes the second indoor LEV 14*b*, the second relay cutoff valve 45*b*, and the fourth relay cutoff valve 46*b*. After step S14, the processing proceeds to step S15.

At step S15, the controller 54 operates the compressor 25 to start the refrigerant pump-down operation. After step S15, the processing proceeds to step S16. The refrigerant is collected to the side of the outdoor heat exchanger 21 by the pump-down operation. Then, when the pressure detected by the pressure sensor 28 becomes equal to or lower than the above-described pressure set in advance at step S16, the processing proceeds to step S17.

At step S17, the controller 54 closes the first indoor LEV 14*a*, the first relay cutoff valve 45*a*, and the third relay cutoff valve 46*a*. After step S17, the processing proceeds to step S18. At step S18, the controller 54 opens the second indoor LEV 14*b*, the second relay cutoff valve 45*b*, the fourth relay cutoff valve 46*b*, the first relay LEV 43, and the second relay LEV 44. When the processing at step S18 is completed, the series of operations of the pump-down operation are ended.

According to the air conditioner configured as described above, effects same as those of Embodiment 1 can be achieved with a configuration including a relay and capable of simultaneously performing operations of different kinds at a plurality of indoor units. Since the above-described first and second isolators are configured by using cutoff valves included in the relay, a dedicated cutoff valve does not need to be provided in each indoor unit.

INDUSTRIAL APPLICABILITY

The present invention is applicable to an air conditioner including a refrigerant circuit connecting a plurality of indoor heat exchangers and an outdoor heat exchanger, the plurality of indoor heat exchangers connected in parallel, the outdoor heat exchanger connected in series to the plurality of indoor heat exchangers.

REFERENCE SIGNS LIST

10*a* First indoor unit
10*b* Second indoor unit
11*a* First indoor heat exchanger
11*b* Second indoor heat exchanger
12*a* First indoor unit fan
12*b* Second indoor unit fan
13*a* First indoor metal connector
13*b* Second indoor metal connector
14*a* First indoor LEV
14*b* Second indoor LEV
15*a* First cutoff valve
15*b* Second cutoff valve
20 Outdoor unit
21 Outdoor heat exchanger
22 Outdoor unit fan
23 Refrigerant pipe
24 Four-way valve
25 Compressor
26 Outdoor LEV
27 Accumulator
28 Pressure sensor
29 Outdoor metal connector
30*a* First refrigerant leak sensor
30*b* Second refrigerant leak sensor
40 Relay unit
41 Gas-liquid separator
42 Relay heat exchanger
43 First relay LEV
44 Second relay LEV
45*a* First relay cutoff valve
45*b* Second relay cutoff valve
46*a* Third relay cutoff valve
46*b* Fourth relay cutoff valve
47 Relay metal connector
48 Relay trifurcate part
51 Leak detection unit
52 Storage unit
53 Notification unit
54 Controller
60 Check valve
70 Indoor side trifurcate part

The invention claimed is:

1. An air conditioner comprising:

a refrigerant circuit connecting a first indoor heat exchanger, a second indoor heat exchanger and an outdoor heat exchanger by a refrigerant pipe in which refrigerant is enclosed, the first indoor heat exchanger and the second indoor heat exchanger connected in parallel, the outdoor heat exchanger connected in series to the first indoor heat exchanger and the second indoor heat exchanger, the refrigerant circuit having a compressor, an accumulator and a four-way valve, the compressor, the accumulator and the four-way valve connected between the first and second indoor heat exchangers and the outdoor heat exchanger;

a first indoor unit casing housing the first indoor heat exchanger;

a second indoor unit casing housing the second indoor heat exchanger;

a first leak detector configured to detect a leak of the refrigerant inside the first indoor unit;

a second leak detector configured to detect a leak of the refrigerant inside the second indoor unit;

a first isolator configured to isolate the first indoor heat exchanger from the refrigerant circuit;

a second isolator configured to isolate the second indoor heat exchanger from the refrigerant circuit;

a controller configured to, when at least one of the first leak detector and the second leak detector detects the leak of the refrigerant, operate the compressor while the four-way valve is set to a cooling direction to perform a pump-down operation in which the refrigerant is collected to a side of the outdoor heat exchanger, and a pressure sensor configured to detect pressure of the refrigerant in the refrigerant pipe on the side of the outdoor heat exchanger, the controller configured to isolate the second indoor heat exchanger from the refrigerant circuit by the second isolator in the pump-down operation when the first leak detector detects the leak of the refrigerant and the second leak detector does not detect the leak of the refrigerant, to isolate the first indoor heat exchanger from the refrigerant circuit by the first isolator in the pump-down operation when the second leak detector detects the leak of the refrigerant and the first leak detector does not detect the leak of the refrigerant, to end the pump-down operation when the pressure of the refrigerant in the refrigerant pipe on the side of the outdoor heat exchanger has become equal to or lower than a pressure set in advance, and to operate the compressor while the four-way valve is set to a heating direction when a time set in advance has elapsed since the pump-down operation is started but the pressure of the refrigerant in the refrigerant pipe on the side of the outdoor heat exchanger has not become equal to or lower than the pressure set in advance.

2. The air conditioner according to claim 1, wherein when the first leak detector detects leak of the refrigerant and the second leak detector does not detect leak of the refrigerant, the controller connects the second indoor heat exchanger to the refrigerant circuit and isolates the first indoor heat exchanger from the refrigerant circuit by the first isolator after the pump-down operation and then resumes circulation of the refrigerant, and when the second leak detector detects leak of the refrigerant and the first leak detector does not detect leak of the refrigerant, the controller connects the first indoor heat exchanger to the refrigerant circuit and isolates the second indoor heat exchanger from the refrigerant circuit by the second isolator after the pump-down operation and then resumes circulation of the refrigerant.

* * * * *